US005953967A

United States Patent [19]

Junkers et al.

[11] Patent Number: 5,953,967

[45] **Date of Patent: *Sep. 21, 1999**

[54] FLUID-OPERATED CYLINDER-PISTON UNIT, AND A TOOL PROVIDED THEREWITH

[76] Inventors: John Junkers, 7 Arrowhead La., Saddle River, N.J. 07540; Jeff Reiman, 261 Harriot Ave., Harrington Park, N.J. 07640

[ * ] Notice: This patent issued on a continued prosecution application filed under 37 CFR 1.53(d), and is subject to the twenty year patent term provisions of 35 U.S.C. 154(a)(2).

[21] Appl. No.: 08/654,302

[22] Filed: May 28, 1996

[51] Int. Cl.[6] ..... B25B 13/46

[52] U.S. Cl. ..... 81/57.39; 92/52; 92/53; 91/167 R

[58] Field of Search ..... 81/57.39, 57.44; 92/52, 53; 91/167 R, 173

[56] References Cited

U.S. PATENT DOCUMENTS

| | | | |
|---|---|---|---|
| 3,259,027 | 7/1966 | Phillipson et al. | 92/52 X |
| 3,426,649 | 2/1969 | Koppers | 92/52 X |
| 3,592,108 | 7/1971 | Roseen | 92/52 X |
| 3,656,411 | 4/1972 | Plester et al. | 92/52 X |
| 4,726,281 | 2/1988 | De Filippi | 92/52 X |
| 4,759,257 | 7/1988 | Hund, Jr. | 92/52 X |

*Primary Examiner*—D. S. Meislin
*Attorney, Agent, or Firm*—Michael J. Striker

[57] ABSTRACT

A fluid-operated cylinder-piston unit has a cylinder forming an inner space, a piston unit movable in the inner space and including a first piston and a second piston movable relative to one another and each having a displacement area at one end and a force applying area at another opposite end. The pistons are arranged so as to form a smaller displacement area associated with one of the pistons and a larger displacement area associated with both of the pistons. A fluid supply to the piston unit is performed so that first only one of the pistons moves and another of the pistons remains stationary during an advance stroke, and during a return stroke fluid has to be applied only to the displacement area of the one piston, while thereafter another of the pistons is moved as well under the action of fluid and both pistons move to apply a larger force due the larger total displacement area and during a return stroke fluid is applied to the larger displacement area.

2 Claims, 3 Drawing Sheets

FLUID-OPERATED CYLINDER-PISTON UNIT, AND A TOOL PROVIDED THEREWITH

BACKGROUND OF THE INVENTION

The present invention relates generally to fluid-operated cylinder-piston units, which can be used for example for fluid-operated tools.

The present invention also relates to a fluid-operated tool provided with the inventive fluid-operated cylinder-piston unit.

Fluid operated units, in particular hydraulic pumps have usually two states. The first stage is a high flow, low pressure stage, while the second stage is a low flow, high pressure stage. 10,000 psi pumps usually switch at 1,000 psi and the flow decreases at that point to just 10% of the low pressure stage.

The existing fluid-operated cylinder-piston units have the problem that there are only two ways known to increase the speed of the advance stroke. One way to solve this problem is to increase the flow of the pump which, however, requires a more expensive and a larger and heavier pump. Another way is to use the fluid medium from the front piston chamber which contains the piston rod, and let it flow into the rear chamber when the fluid pressure is applied to it. The latter approach has the disadvantages that while the advance stroke speed is increased by the amount of fluid located in the front chamber, the force output is decreased by the same ratio. Also, a switch has to be mounted to the tool in order to switch back the cylinder-piston unit to a regular function manually, to obtain full force based on the piston displacement (usually the bore) and pressure.

The biggest problem is, however, not the advance stroke speed, but the return stroke speed which was not addressed in the above described solutions. Obviously, it takes less fluid medium to return the piston than to advance it, since the return displacement is decreased by the piston rod area. On larger cylinder-piston units, the rear chamber contains a lot of fluid medium which needs to be pressed through a relatively small hole, namely the inlet hole. On hydraulic tools, this hole is usually ¼ inch. The reason is that more small tools are purchased by customers and since the customer wants to operate all tools off the same pump and the same hoses, the connectors have to stay the same. This represents a restriction. The pump pressure decreases therefore and in many cases the pump goes from its first stage to its second stage to return the piston where its fluid flow speed decreases by 90%. While this is not important at higher force output, it decreases the potential run-down speed at lower force output where most of the turning is done by hydraulic wrenches.

SUMMARY OF THE INVENTION

Accordingly, it is an object of the present invention to provide a fluid-operated cylinder-piston unit, which avoids the disadvantages of the prior art.

In keeping with these objects and with others which will become apparent hereinafter, one feature of the present invention resides, briefly stated, in a fluid-operated cylinder-piston unit which has a cylinder forming an inner space and movable in the inner space, the piston means including a first piston and a second piston movable relative to one another and each having a displacement surface at one end and a force applying surface at another opposite end, the pistons being arranged so as to form a smaller displacement surface associated with one of the pistons and a larger displacement surface associated with both of the pistons, and means for supplying fluid to the piston means so that first only one of the pistons moves but another of the pistons remains stationary during an advance stroke, and during a return stroke fluid has to be applied only to the displacement surface of the one piston, while thereafter another of the pistons is moved as well under the action of fluid and both pistons move to apply a larger force due to the larger total displacement surface, and during a return stroke fluid is applied to the larger displacement surface.

In accordance with another important feature of the present invention, the fluid-operated cylinder-piston unit is designed so that after the first piston has been displaced, the second piston is then displaced automatically when a fluid pressure reaches a predetermined value. In other words, first the fluid is supplied only to one piston, and when the pressure reaches a predetermined value, the fluid is supplied to the other piston as well. Thus, during the first stage, a high flow, low pressure operation is performed and the piston of the cylinder-piston unit reciprocates faster and applies low pressure, for example in the initial operation of tightening of a nut when all gaps have to be compensated and the nut has to be screwed fast on the bolt. During a second stage, when both pistons are displaced, a low flow, high pressure operation takes place so that a higher pressure is applied for final tightening of the nut on the bolt. The switching of fluid from the fluid supply only to one piston, to the fluid supply to both pistons is performed automatically when a predetermined fluid pressure is reached, and therefore operators errors are completely avoided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
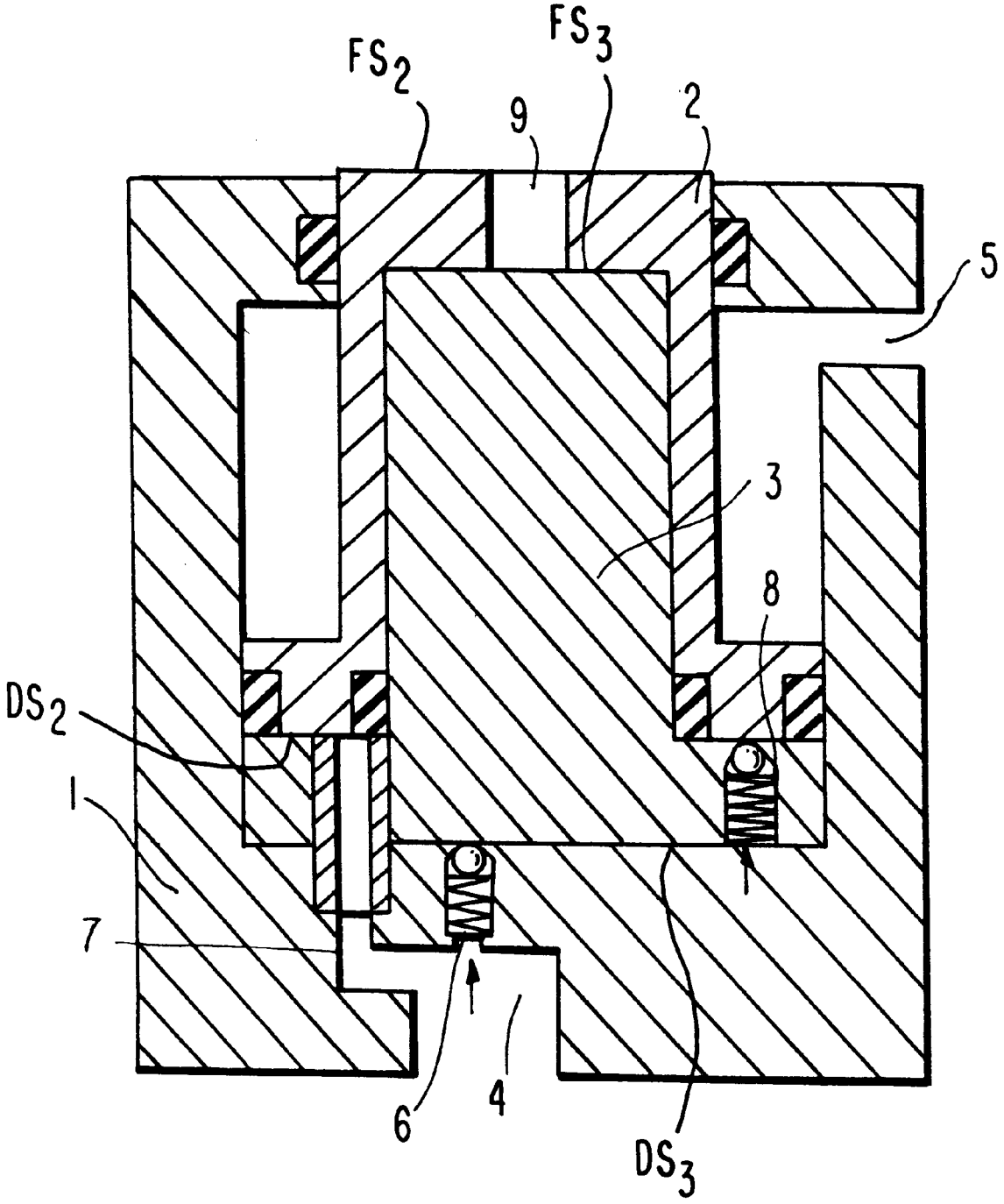
FIG. 1 is a view showing a fluid-operated cylinder-piston unit in accordance with a first embodiment of the present invention.

A fluid-operated cylinder-piston unit in accordance with the present invention has a housing 1 which forms a cylinder and piston means movably arranged in the housing. The piston means include a first piston identified with reference numeral 2 and a second piston identified with reference numeral 3. The displacement surface of each piston ($DS_2$, $DS_3$, $DS_{2'}$, $DS_{3'}$, $DS_{2''}$, $DS_{3''}$, ) is a surface on which fluid acts to displace the piston, and in the drawings this is the lower surface of the corresponding piston. The force applying surface of each piston ($FS_2$, $FS_3$; $FS_{2'}$, $FS_{3'}$, $FS_{2''}$; $FS_{3''}$) is the surface by which the piston applies a force to further structure, and in the drawings this is the upper surface of each piston. The cylinder 1 is provided with passages for a pressure fluid. The passages include an advance pressure inlet 4 for supplying pressure fluid into an inner space of the housing 1 to provide an advance stroke of the piston means, and a return pressure inlet 5 for supplying a pressure fluid into the inner space of the housing to provide a return stroke of the piston means.

A portion of the advance pressure inlet 4 which leads to the displacement surface $DS_3$ of the second piston 3 is provided with a check valve 6. The check valve 6 is formed so that it is closed during the advance stroke in response to a fluid pressure in the advance pressure inlet and opens when return pressure is applied to let the pressure fluid out. Another portion of the advance pressure inlet 4 which leads to the displacement surface $DS_2$ of the second piston 2 is provided with an inlet nipple 7. A check valve 8 is also associated with the displacement surface $DS_2$ of the second piston 2. The check valve 8 is present at high pressure so that when resistance to the piston means exceeds a predetermined advance pressure of the first piston 2, pressure fluid flows behind the second piston 3 to displace the second piston. Finally, the first piston 2 is provided with an air passage for air inflow and outflow during the operation. Each piston 2, 3 has a smaller force applying surface and a smaller displacement surface than both pistons 2 and 3 together. The elements 4, 5, 6, 7, 8 forms means for supplying fluid.

During the operation, the pressure fluid is first supplied into the advance pressure inlet 4 and flows through the inlet nipple 7 toward the displacement surface $DS_2$ of the first piston 2. The fluid cannot flow to the displacement surface $DS_3$ of the second piston 3 since the check valve 8 is closed. The first piston 2 is therefore moved to perform an advance stroke in a high-flow low pressure mode since its displacement surface $DS_2$ is relatively small. In order to perform a return stroke, the pressure fluid is supplied through the return pressure inlet 5 and moves the first piston back. This operation is repeated many times. When the fluid-operated cylinder-piston unit is utilized for tightening threaded connectors, for example a nut on a bolt, then during this first high-flow, low pressure stage the first piston 2 reciprocates with high speed so that gaps in the connection are compensated and the nut is turned on the bolt with a high speed, before it is necessary to tighten the connection with a high force. In this first stage, during the return stroke the pressure fluid acts on a relatively small displacement surface of the first piston 2. Then when it is necessary to finally tighten the threaded connector, and a resistance to turning of the nut and therefore the resistance to the fluid pressure supply exceeds a predetermined value, the check valve 8 opens and the pressure fluid flows behind the second piston 3 as well, so that the second piston is also moved in advance stroke, and a larger force is applied due to a larger total displacement surface of two pistons. On the return stroke, the pressure fluid of the larger displacement surface has to be returned. The pressure fluid flows out from the area behind the second piston 3 through the check valve 6.

Figure 2:
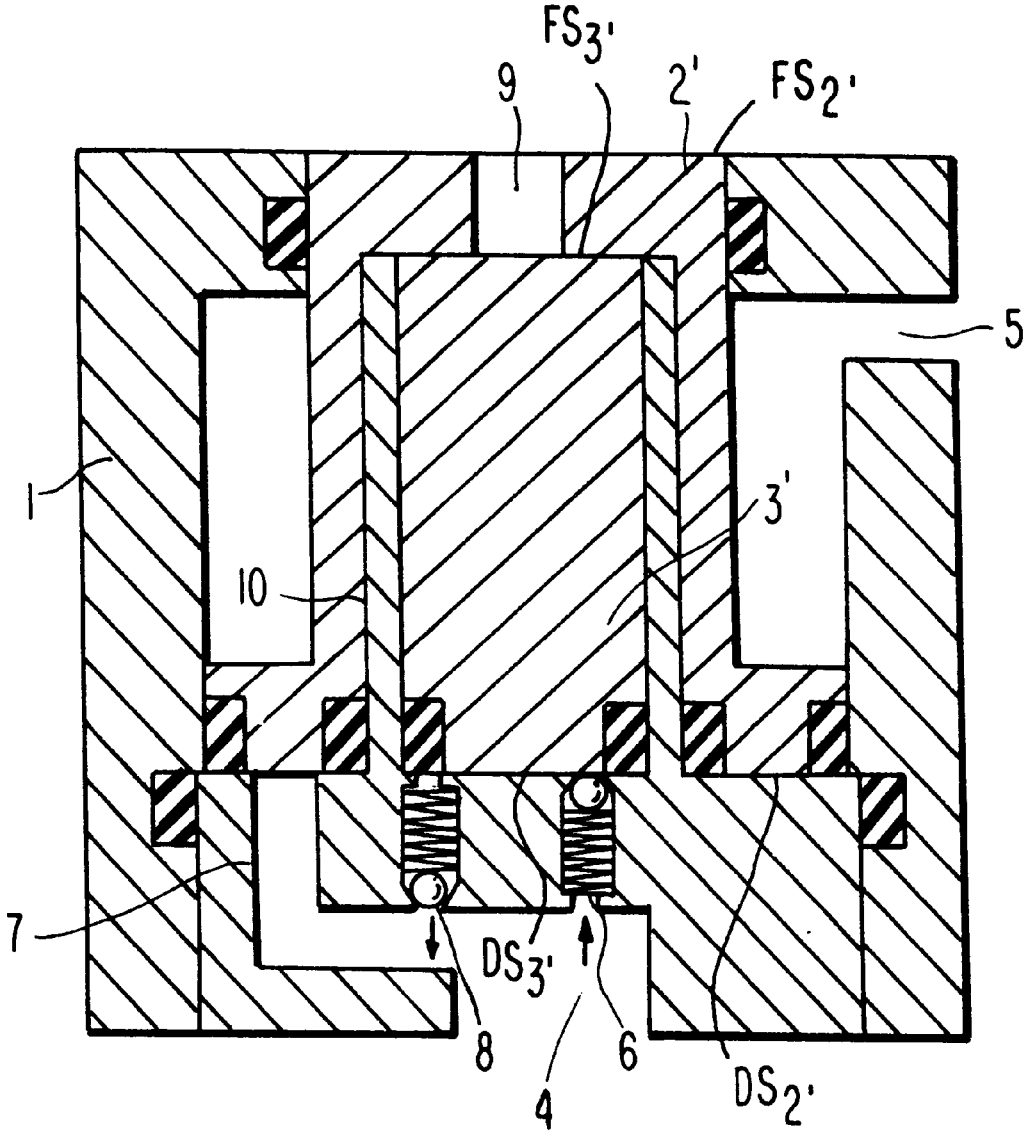
FIG. 2 is a view showing a fluid-operated cylinder-piston unit in accordance with another embodiment of the present invention.

The fluid-operated cylinder-piston unit of FIG. 2 has parts which substantially correspond to the parts of the fluid-operated cylinder-piston unit of FIG. 1 and they are identified with the same reference numerals. In the embodiment of FIG. 1 the first smaller displacement surface is the displacement surface $DS_2$ of the first piston 2, and entire displacement surface is represented by the displacement surface $DS_3$ of the second piston 3. In the embodiment of FIG. 2 an additional sleeve 10 is arranged between the first piston 2' and the second piston 3'. In this embodiment a first displacement surface is the displacement surface $DS_{2'}$ of the first piston 2' and it represents a part of the total displacement surface $DS_{3'}$ of both pistons.

Figure 3:
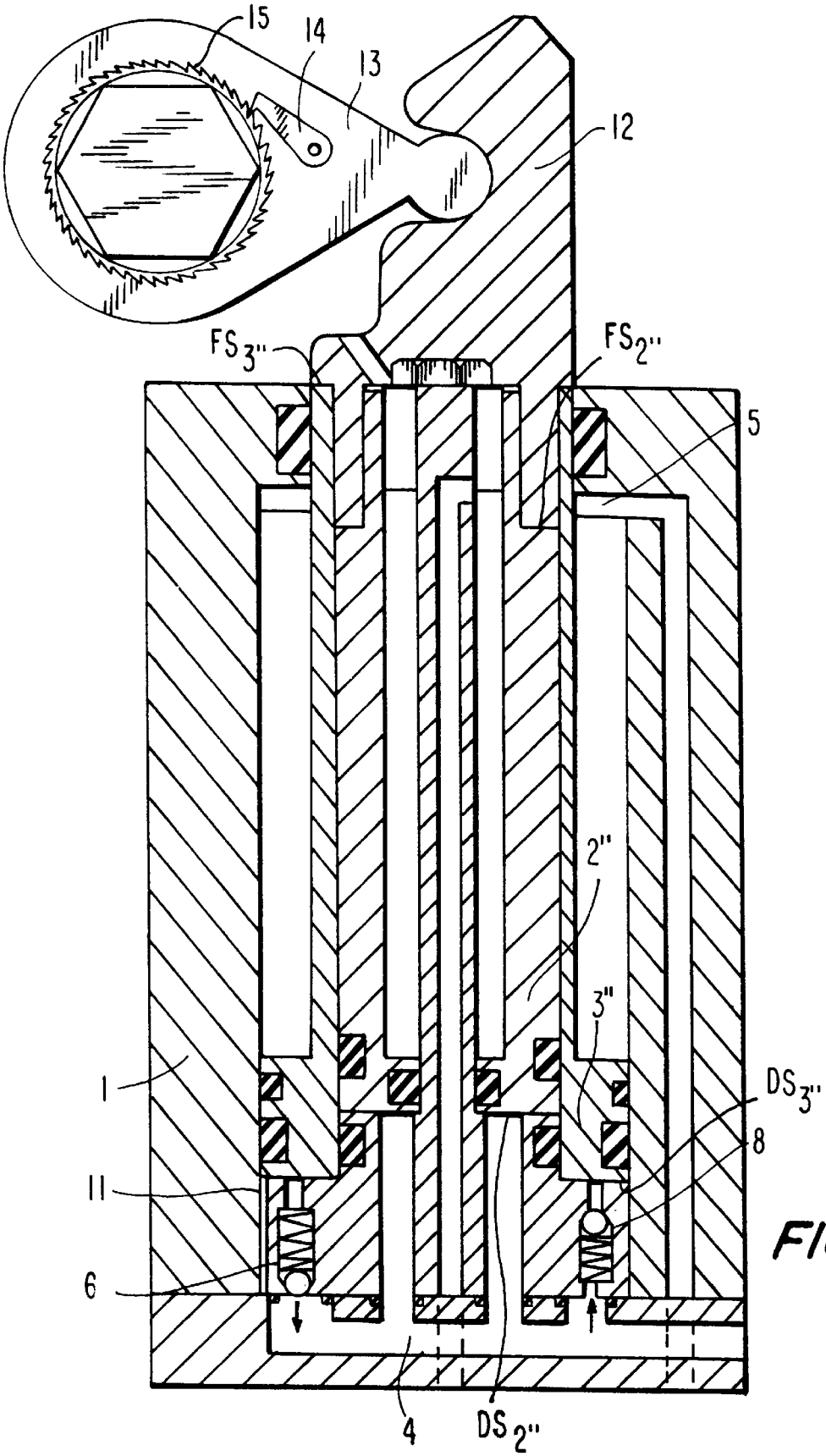
FIG. 3 is a view showing a fluid-operated cylinder-piston unit in accordance with still a further embodiment of the present invention.

In the embodiment of FIG. 3, the parts corresponding to the parts of the first two embodiments are identified with the same reference numerals. In addition to the first piston 2" and the second piston 3", a stationary member 11 is provided. It contains the fluid passages and accommodates the check valves 6 and 8. During the advance stroke the fluid is supplied to the smaller displacement surface $DS_{2''}$ of the first piston 2", and subsequently to the smaller displacement surface $DS_{3''}$ of the second piston 3". During the return stroke the fluid is supplied through the stationary member 11 to the rear displacement surface $DS_{2''}$ of the first piston 2" and through the return pressure inlet to the rear displacement $DS_{3''}$ of the second piston 3". As can be seen from the drawings, the piston means is connected with a transition element 12, which, for example in fluid-operated tools, is connected with a drive lever connectable to a pawl-ratchet mechanism of the fluid-operated wrench.

As can be seen from FIG. 3 shows the connecting member 12 connected with a drive lever 13 which carries a pawl 14 engeable with a ratchet 15 of the fluid-operated wrench. The ratchet 15 is provided either with an inner polygonal opening or with a socket having a polygonal opening for engaging a threaded connector, for example a nut of a bolt-nut threaded connector.

It will be understood that each of the elements described above, or two or more together, may also find a useful application in other types of constructions differing from the types described above.

While the invention has been illustrated and described as embodied in a fluid-operated cylinder-piston unit and a tool provided therewith, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated cylinder-piston unit, comprising a cylinder forming an inner space; piston means movable in said inner space, said piston means including a first piston and a second piston movable relative to one another and each having a displacement surface at one end and a force applying surface at another opposite end, one of said pistons have a smaller force applying and displacement surface than both said pistons which have together a larger total force applying and displacement surface than that of said one piston; and means for supplying fluid to said piston means, said pistons being arranged relative to one another and said supplying means supply the fluid to said pistons so that first during an advance stroke fluid is applied to said displacement surface of said one piston and only said one piston moves to perform an advance stroke in a high-flow low pressure mode as the other of said piston remains stationary, and during a return stroke fluid is applied only to said displacement surface of said one piston, while thereafter when a predetermined advanced pressure is exceeded fluid is applied also to said displacement surface of the other piston and the other piston is moved as well and both pistons move to apply a largerforce due to said larger total force applying surface and during a return stroke fluid is applied to said larger total displacement surface.

2. A fluid-operated tool, comprising means for tightening and loosening a threaded connector by turning a part of the threaded connector; and drive means for driving said means for tightening and loosening, said drive means including a fluid-operated cylinder-piston unit having a cylinder forming an inner space, piston means movable in said inner space, said piston means including a first piston and a second piston movable relative to one another and each having a displacement surface at one end and a force applying surface at another opposite end, each of said pistons have a smaller displacement surface than both said pistons which have together a larger total force applying and displacement surface than that of each of said pistons, and means for supplying fluid to said piston means, said pistons being arranged relative to one another and said supplying means supply the fluid to said pistons so that first during an advance stroke fluid is applied to said displacement surface of said one piston and only said one piston moves to perform an advance stroke in a high-flow low pressure mode as the other of said pistons remains stationary, and during a return stroke fluid is applied only to said displacement surface of said one piston, while thereafter when a predetermined advanced pressure is exceeded fluid is applied also to said displacement surface of the other piston and the other piston is moved as well and both pistons move to apply a larger force due to said larger total force applying surface and during a return stroke fluid is applied to said larger total displacement surface.

* * * * *